US006632075B2

(12) United States Patent
Hallgren

(10) Patent No.: US 6,632,075 B2
(45) Date of Patent: Oct. 14, 2003

(54) SEALING AND COOLING DEVICE

(75) Inventor: Gert Hallgren, Hagersten (SE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 97 days.

(21) Appl. No.: 09/933,590

(22) Filed: Aug. 22, 2001

(65) Prior Publication Data

US 2002/0025262 A1 Feb. 28, 2002

(30) Foreign Application Priority Data

Aug. 23, 2000 (SE) ..... 0002978

(51) Int. Cl.[7] ..... F04B 17/00
(52) U.S. Cl. ..... 417/373; 277/366
(58) Field of Search ..... 417/373, 423.11, 417/36, 368; 277/366, 405, 367, 361

(56) References Cited

U.S. PATENT DOCUMENTS 5,181,729 A * 1/1993 Forssberg et al. ..... 277/367
6,224,354 B1 * 5/2001 Brandt et al. ..... 417/423.11
6,305,692 B1 * 10/2001 Arbeus ..... 277/361
6,446,975 B1 * 9/2002 Bratthall ..... 277/366

* cited by examiner

*Primary Examiner*—Teresa Walberg
*Assistant Examiner*—Vinod D. Patel
(74) *Attorney, Agent, or Firm*—Ware, Fressola, Van Der Sluys & Adolphson LLP

(57) ABSTRACT

The invention concerns a sealing- and cooling system for a submersible machine, such as a pump or a mixer.

The device comprises an easily replaceable (4) containing mechanical face seals with an intermediate room for a barrier liquid where a circulation pump (10) is arranged for circulation of said liquid along the seals as well as around the driving unit (1) of the machine. During circulation, the liquid passes a first narrow gap (6) around the driving unit where heat is absorbed and a second narrow gap (7) where heat is discharged.

1 Claim, 2 Drawing Sheets

SEALING AND COOLING DEVICE

BACKGROUND OF THE INVENTION

1. Field of Invention

The present invention concerns a device for a submersible machine, such as a pump, a turbine or a mixer.

2. Description of Related Art

A machine of this type normally includes an electrically driven motor and a hydraulic unit with an impeller connected to the motor via a rotary driving shaft. In order to prevent the medium within the hydraulic unit from flowing along the shaft and penetrate the electric motor and cause damage, one or several seals are arranged between the motor and the hydraulic unit. A common type of seal is the so-called mechanical face seal, which comprises one seal ring rotating with the shaft and one stationary seal ring mounted in the surrounding housing. The two rings are pressed together by spring force thus preventing medium from penetrating between them.

If the medium within the hydraulic unit contains pollutants, a special problem occurs. As the pressure within the hydraulic unit is higher, pollutants may penetrate between the seal surfaces an cause damage, meaning that the seal result is worsened or fails totally.

In order to solve this problem it is common to arrange two mechanical seals parted by a room filled with a barrier liquid such as oil, which lubricates and cools the surfaces. By this the seal adjacent the electric motor will always operate with a clean medium and thus the risks for damages will decrease drastically. If the seal adjacent the hydraulic unit should be damaged, medium from said unit may enter the barrier liquid room, but by controlling said liquid at regular intervals, the seal could be repaired or replaced before any serious damage has occurred. An example on such a design is shown in the Swedish patent No 381 318.

If it has been noted that the barrier liquid has been too diluted by the medium in the hydraulic unit, the seal adjacent said unit must be replaced. If the dilution has been considerable, there is a risk that also the other seal has been damaged and therefore it might be preferable to replace both seals at the same time.

In order to make such a replacement easier to obtain, it has been suggested to build them together into a unit which makes service easier and increases the reliability. Examples on such designs are shown in the Swedish patents 200 144 and 466 925. In order to obtain a good circulation of the barrier liquid within the seal unit, it has been suggested to arrange a pump within the latter. Especially in a case where it has been chosen to use a closed cooling system for the electric motor using the barrier liquid as cooling medium, a pump is necessary if a sufficient flow should be obtained. Known designs such as those shown in the Swedish patent 327 904 have however certain disadvantages concerning space demand and efficiency.

SUMMARY OF THE INVENTION

This invention concerns a device which in an effective and secure way obtains the necessary circulation even at a low rotation speed and which has a very limited space demand.

BRIEF DESCRIPTION OF THE DRAWINGS

The invention is disclosed more closely below with reference to the enclosed drawings which show a cut through a pump unit provided with a seal arrangement according to the invention, FIG. 1, and a principle sketch of the cooling system, FIG. 2.

DETAILED DESCRIPTION OF THE INVENTION

Figure 1:
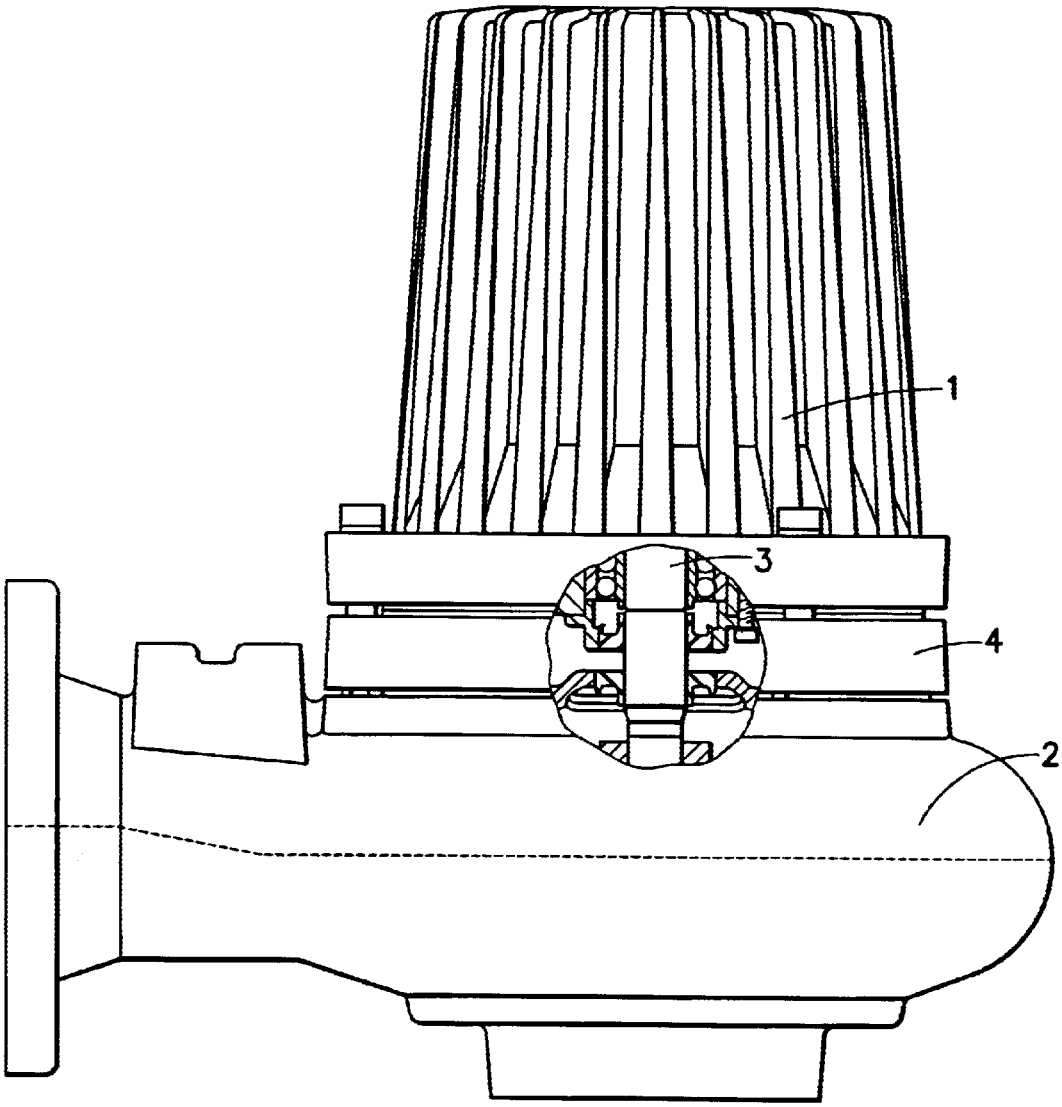
FIG. 1 PRIOR ART
Figure 2:
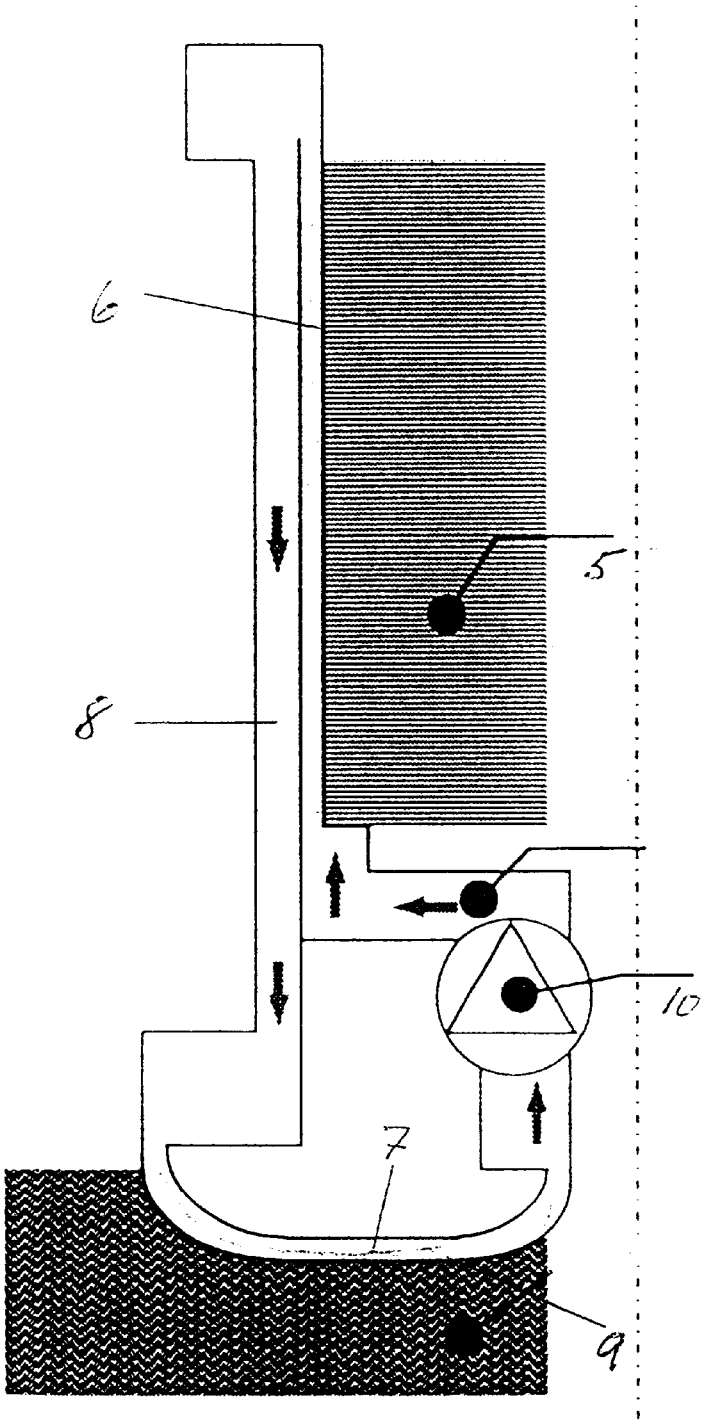

In the drawings 1 stands for a driving unit, 2 a hydraulic unit and 3 a driving shaft between the two. 4 stands for a seal unit arranged between the driving unit and the hydraulic unit and 5 the stator in the driving unit 1. 6 and 7 stand for gaps for barrier/cooling liquid, 8 a return conduit, 9 a wall towards a space for the working medium of the machine and 10 an internal pump for circulation of the barrier/cooling liquid.

The driving shaft 3 between the driving unit 1 and the hydraulic unit 2 is sealed in a conventional manner by two mechanical seals within the seal unit 4, the seals being separated by a room for barrier/cooling medium which is circulated by the internal pump 10.

In the designs used up to now, a centrifugal pump impeller with a low specific rotation speed is used where the static head cannot be utilized because of insufficient sealing. The efficiency of such a pump is therefore extremely low, around 5%. The flow obtained will therefore be almost entirely laminar which results in quite a low heat exchange rate in the cooling channels of the driving unit. The relation between flow losses and actual geometric conditions in a submersible pump means, that the best heat exchange is obtained by a pump having a high specific rotation speed. This is very important in order to secure a turbulent flow which is superior for a good heat exchange.

The heat exchange gaps are one gap 6 surrounding the stator of the driving unit and a second gap 7, where one of the walls 9 is cooled by the working medium of the machine. During circulation, the cooling medium absorbs heat from the stator 4 and emits it to the working medium via the wall 9. The transport between the two gaps takes place through an outer conduit 8, the dimension of which is such, that the flow losses are minimized. The conduit 8, as well as the other parts of the system in front of and after the gaps, operate as buffer volumes for the cooling medium, which secures that the flow through the gaps always has an even speed independent of outer disturbances.

According to the invention there is secured a turbulent flow in the gaps by a suitable dimensioning of the widths of the gaps depending on the volume of the flow, the lengths of the gaps, the performance of the circulating pump and the qualities of the cooling medium. In order to secure that the heat transfer will be as effective and even as possible, the flow speed through the gaps must be kept at a constant level. This means that the cross section of the gaps must be constant along their entire lengths. Therefore, the gap 7, which is mainly radially directed, is designed with an inward increasing width to compensate for the radially inward decreasing space. The width increase can be described according to the formula:

$$d=d_0\cdot\{r_0/r\}$$

where $d_0$ is gap width at the radius $r_0$, the periphery, and d is the gap width at a radius r.

According to the invention there is obtained a device where an even and efficient cooling is secured even at relatively low rotation speeds, as the gaps where the heat exchange takes place are so designed, that the flow becomes turbulent and in addition are so dimensioned, that the flow speed is kept constant, independent of the locations and directions of the gaps.

In the description above a mechanical seal arrangement has been discussed, where the circulation pump operates a barrier liquid which simultaneously is used for cooling the motor. The invention is however not limited to this embodiment, but also when a separate liquid is used for the cooling.

THE SCOPE OF THE INVENTION

The dimensions and geometries for any of the embodiments described herein are merely for illustrative purposes and, as much, any other dimensions may be used if desired, depending on the application, size, performance, manufacturing requirements, or other factors, in view of the teachings herein.

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein without departing from the spirit and scope of the present invention.

What is claimed is:

1. A sealing and cooling device for a submersible machine, such as a pump or a mixer, said submersible machine comprising a driving unit such as an electric motor (1), a hydraulic unit (2) with a pump impeller or a propeller connected to the motor via a driving shaft (3) and an intermediate seal unit (4), the latter comprising two mechanical face seals, separated by a room containing a liquid which acts as a barrier medium for the two seals as well as a cooling medium for the motor, a circulation pump (10) for said medium being integrated in the seal unit (4), characterized in that the barrier/cooling medium during its circulation obtains a mainly turbulent flow and passes at least two narrow gaps, a first gap (6) surrounding the stator (5) of the motor, where heat is absorbed, and a second gap (7) which on one of its sides is limited by a wall (9) that is cooled by the working medium of the machine, said second gap (7) being mainly radially directed and having a radially inward increasing width for compensation of the inward decreasing space, thereby securing an essentially constant cross section and a constant flow speed through the gap.

* * * * *

UNITED STATES PATENT AND TRADEMARK OFFICE

CERTIFICATE OF CORRECTION

PATENT NO. : 6,632,075 B2
DATED : October 14, 2003
INVENTOR(S) : Hallgren

It is certified that error appears in the above-identified patent and that said Letters Patent is hereby corrected as shown below:

Column 2,
Line 36, "4" should read -- 5 --.
Line 57, after equation, please insert -- D.8 --.

Signed and Sealed this

Tenth Day of August, 2004

JON W. DUDAS
*Acting Director of the United States Patent and Trademark Office*